United States Patent [19]

Kurano et al.

[11] Patent Number: 5,023,585

[45] Date of Patent: Jun. 11, 1991

[54] COMMON-MODE CHOKING COIL

[75] Inventors: Shinichi Kurano; Masahiro Bando; Yasuhiro Mitsuya; Takeshi Tanabe, all of Nagaokakyo, Japan

[73] Assignee: Murata Manufacturing Co., Ltd., Japan

[21] Appl. No.: 438,587

[22] Filed: Nov. 17, 1989

[30] Foreign Application Priority Data

Nov. 17, 1988 [JP] Japan ..... 63-150513
Jan. 13, 1989 [JP] Japan ..... 1-3200
Jan. 30, 1989 [JP] Japan ..... 1-21916

[51] Int. Cl.[5] ..... H01F 15/14; H01F 27/26

[52] U.S. Cl. ..... 336/69; 336/181; 336/184; 336/192; 336/210

[58] Field of Search ..... 336/180, 181, 184, 210, 336/65, 192, 198, 69

[56] References Cited

U.S. PATENT DOCUMENTS 2,375,593 5/1945 Sontheimer et al. ..... 336/184 R
3,353,132 11/1967 D'Entremont ..... 336/181
3,541,424 11/1970 Tada et al. ..... 336/184 X
3,590,329 6/1971 Krepps, Jr. ..... 336/192 X
3,629,761 12/1971 Lundgren et al. ..... 336/192
4,668,930 5/1987 Francis, Jr. ..... 336/184 X
4,763,093 8/1988 Cirkel et al. ..... 336/181 X

FOREIGN PATENT DOCUMENTS 157626 1/1921 United Kingdom ..... 336/181

*Primary Examiner*—Thomas J. Kozma
*Attorney, Agent, or Firm*—Ostrolenk, Faber, Gerb & Soffen

[57] ABSTRACT

A common-mode choking coil comprises a closed magnetic path core which is formed, for example, by combining two U-shaped cores. Two coils wound in opposite respective directions are mounted on two legs of the closed magnetic path core. These coils are formed by single-layer winding. That is a conductor wire is wound in only one layer, for example, around a bobbin. Then, the bobbins whereon the conductor wire is wound are mounted on the two legs of the closed magnetic path core. For the conductor wire used for the coil, a material having a spring property may be used. Utilizing this spring property of the coil, the closed magnetic path core can be held together by the coil, whereby the two U-shaped cores can be combined. Also, the two coils are identified by colors according to the winding direction of the respective conductor wires.

4 Claims, 6 Drawing Sheets

COMMON-MODE CHOKING COIL

BACKGROUND OF THE INVENTION

1. Field of the Invention

The present invention relates to a common-mode choking coil, and specifically relates to a common-mode choking coil used, for example, for an EMI eliminating filter.

2. Description of the Prior Art

FIG. 11 is a plan view showing one example of a conventional common-mode choking coil which is the background of the present invention. A common-mode choking coil 1 comprises a closed magnetic path core 2. The closed magnetic path core 2 is formed by combining two U-shaped cores 3. These two cores 3 are fixed, for example, by a spring 4 having a U-shaped cross section.

A bobbin 5 is mounted on one leg of the closed magnetic path core 2. Two wire-wound parts 5*b* are formed by collars 5*a* on the bobbin 5. On the two wire-wound parts 5*b*, coils 6*a* and 6*b* are formed respectively by winding a conductor wire. The coils 6*a* and 6*b* are formed by winding the conductor wire in respective directions opposite to each other. When these coils 6*a* and 6*b* are formed, to wind the conductor wire a required number of turns, the conductor wire is wound from one end to the other end of the wire-wound part 5*b* of the bobbin 5, and thereafter the conductor wire is wound from this end toward the original end in a superposed manner on the previously wound wire. Thus, the coils 6*a* and 6*b* are formed by winding the conductor wire in a multi-layered fashion. The ends of the windings of the coils 6*a* and 6*b* are connected to terminals 7 formed, for example, on the bobbin 5.

However, such a common-mode choking coil has a large distributed capacitance because it is formed by winding the conductor wire in a multi-layered fashion. For this reason, the self resonance frequency of the coil is lowered, and a large insertion loss characteristic cannot be obtained in the high frequency region, and thus there has been the problem that an effective elimination of noise cannot be performed.

To solve such a problem, it has been considered to form a single-layer-wound coil by winding the conductor wire in only one layer. The distributed capacitance of the coil can be reduced by winding the coil in a single layer. However, when the coil is formed by single-layer winding, the conductor wire has to be wound by a large number of turns in one layer to obtain a predetermined inductance value, and a large coil length is required. When the coil length becomes large, the magnetic path length of the core also becomes long as a result and the magnetic resistance becomes large, and eventually the insertion loss characteristic is reduced.

Also, in the conventional common-mode choking coil, two U-shaped cores are fixed together in the combined state, and therefore a part such as a spring is required. For this reason, the manufacturing cost of the whole common-mode choking coil is raised due to the cost of this part. Furthermore, the required work for connecting the ends of the coil to the terminals also cause a rise in the cost of the common-mode choking coil.

SUMMARY OF THE INVENTION

Therefore, a principal object of the present invention is to provide a common-mode choking coil excelling in its insertion loss characteristic.

Also, another object of the present invention is to provide a common-mode choking coil having a structure capable of reducing the manufacturing cost.

A common-mode choking coil of the present invention comprises a closed magnetic path core formed by combining two cores and two single-layer-wound coils wound around two legs of the closed magnetic path core, and these two coils are formed by winding a conductor wire in respective directions opposite to each other.

In this structure, the single-layer-wound coil may be constituted by a wire-wound part formed by winding a conductor wire having a spring property and having lead parts extending from both ends of the wire-wound part. Such a coil can be mounted on the leg of the closed magnetic path core and then pulled to stretch it lengthwise. The lead parts of the coil are engaged with the opposite sides of the U-shaped core halves. Then the spring property of the coil will tend to draw the two cores are together. Also, the two coils can be identified by color if desired according to the winding direction of the conductor wire.

In such a common-mode choking coil, each coil is wound in a single layer, and therefore the distributed capacitance thereof is reduced. Also, each coil is mounted on a different leg of the closed magnetic path core, and therefore the magnetic path length of the core is not increased, by comparison with the case where two coils are mounted on one leg. Therefore, in accordance with the present invention, a common-mode choking coil excelling in the insertion loss characteristic is obtainable.

Also, by making the single-layer-wound coil form a wire-wound part using a conductor wire having a spring property and having lead parts extending from this wire-wound part, the two cores can be held together via the lead parts, utilizing this spring characteristic. For this reason, a separable spring or the like for fixing the cores together can be dispensed with. Furthermore, by using the lead part as a terminal of the common-mode choking coil, the manufacturing step of winding the end of the coil around the terminal can be dispensed with. Accordingly, the manufacturing cost of the common-mode choking coil can be reduced.

In this case, the wire-wound part is mounted on the closed magnetic path core after having been pulled to stretch it lengthwise, and therefore the distance between the conductor windings becomes large. Consequently, the stray capacitance between the adjacent conductor wires is reduced, and the effective frequency region of the common-mode choking coil can be extended.

Also, by color-identifying the coil according to the winding direction thereof, the labor required for identifying the two coils can be saved, and errors can be prevented in the assembling process of the choking coil.

These objects and other objects, features and advantages of the present invention will become more apparent from the following detailed description of preferred embodiments of the present invention when taken in conjunction with the accompanying drawings.

DESCRIPTION OF THE PREFERRED EMBODIMENTS

Figure 1:
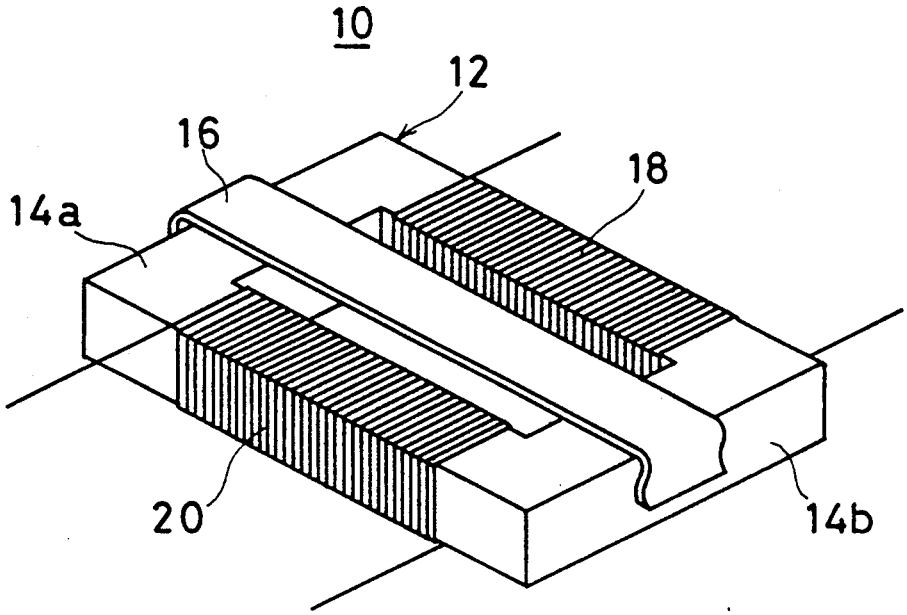
FIG. 1 is a perspective view showing one embodiment of the present invention.
Figure 2:
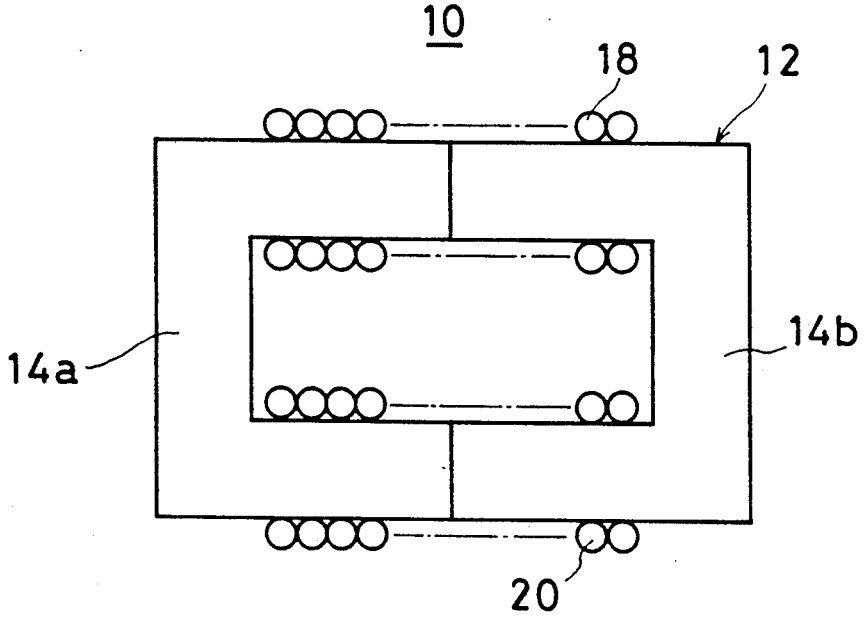
FIG. 2 is a cross-section thereof.

FIG. 1 is a perspective view showing one embodiment of the present invention, and FIG. 2 is a cross-sectional view thereof. This common-mode choking coil 10 comprises a closed magnetic path core 12. The closed magnetic path core 12 is formed by combining two U-shaped cores 14*a* and 14*b*. The closed magnetic path core 12 is formed by making two legs of these U-shaped cores 14*a* and 14*b* butt against each other. These U-shaped cores 14*a* and 14*b* are fixed together, for example, by pushing them together with a U-shaped spring 16.

Coils 18 and 20 are formed respectively on the two legs of the closed magnetic path core 12. For the material of these coils 18 and 20, for example, a copper wire coated with a resin material such as polyurethane, polyester or polyimide is used. The coils 18 and 20 are formed by winding the conductor wire as described above in a single layer. Furthermore, the coils 18 and 20 are formed by winding the conductor wire in the directions reverse to each other.

Figure 3:
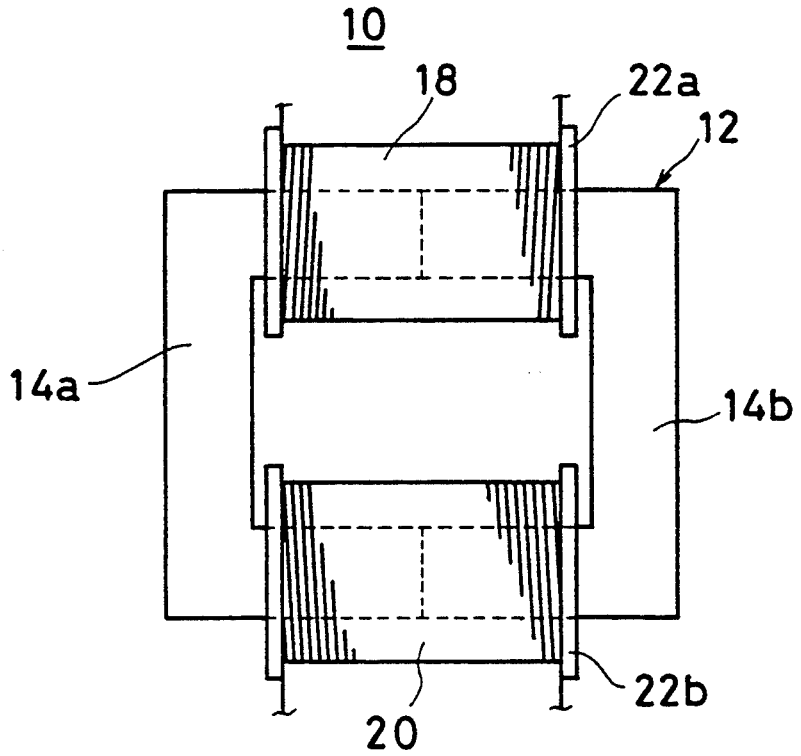
FIG. 3 is a plan view showing another embodiment of the present invention.
Figure 4:
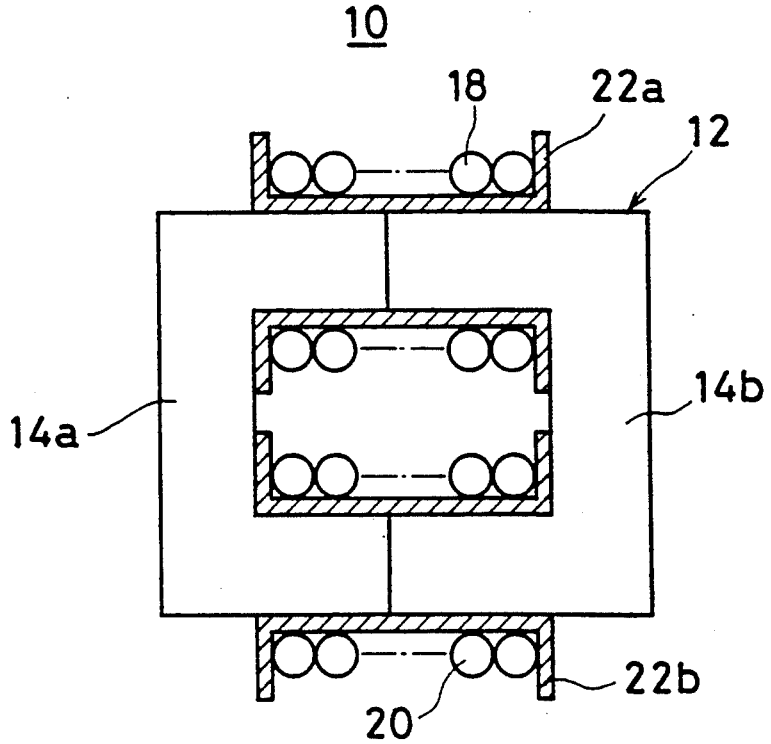
FIG. 4 is a cross-section thereof.

In addition, the two coils 18 and 20 may be formed on bobbins 22*a* and 22*b* as shown in FIG. 3 and FIG. 4. In this case, for example, terminals (not illustrated) are formed on the bobbins 22*a* and 22*b*, and the ends of the coils 18 and 20 are connected to these terminals. Then, the bobbins 22*a* and 22*b* whereon the coils 18 and 20 are formed are mounted on the two legs of the closed magnetic path core 12.

In the common-mode choking coil 10 as mentioned above, the coils 18 and 20 are wound in a single layer, and therefore the distributed capacitance thereof is small in comparison with a multi-layer coil of. Also, the respective coils 18 and 20 are formed on the two legs of the closed magnetic path core 12, and therefore the coil length thereof can be lengthened without increasing the magnetic path length of the core in comparison with the conventional type wherein two coils are formed on one leg. For this reason, the magnetic resistance is not increased even if the coil length is lengthened to form a single layer coil. Accordingly, this common-mode choking coil 10 excels in the insertion loss characteristic in comparison with the conventional type.

Figure 5:
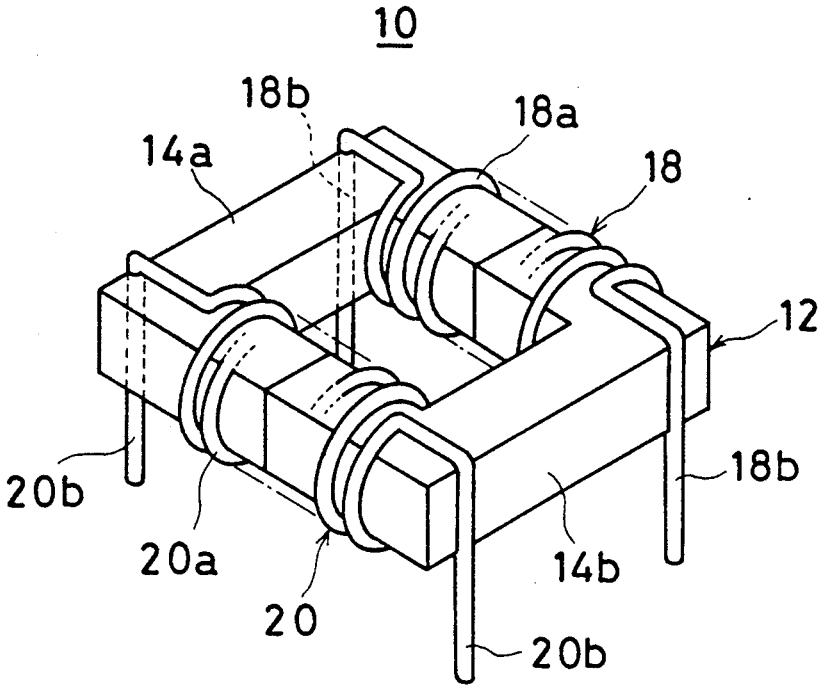
FIG. 5 is a perspective view showing still another embodiment of the present invention.
Figure 6:
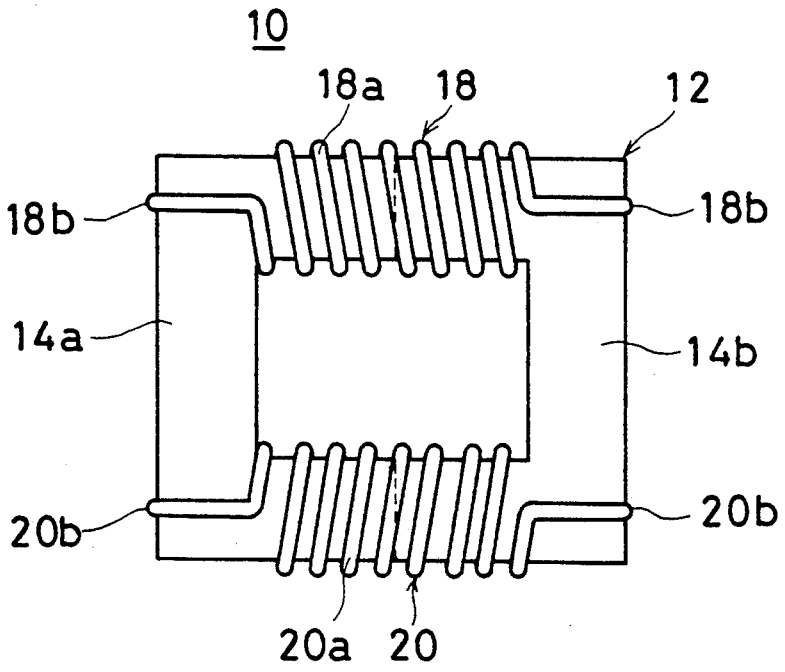
FIG. 6 is a plan view thereof.

In the above-described embodiments, a copper wire whereon a coating material is formed used for the material of the coils 18 and 20, but as shown in FIG. 5 and FIG. 6, the coils 18 and 20 may also be formed of a conductor wire material having a spring property. In this case, the coil 18 is constituted of a wire-wound part 18*a* formed by winding a conductor wire having a spring property and lead parts 18*b* extending from both ends of the wire-wound part. Likewise, the coil 20 is constituted of a wire-wound part 20*a* and lead parts 20*b*. The lead parts 18*b* and 20*b* are formed so as to extend in a direction orthogonal to the center lines of the wire-wound parts 18*a* and 20*a* and the plane of the cores 14*a*, 14*b*.

Figure 7:
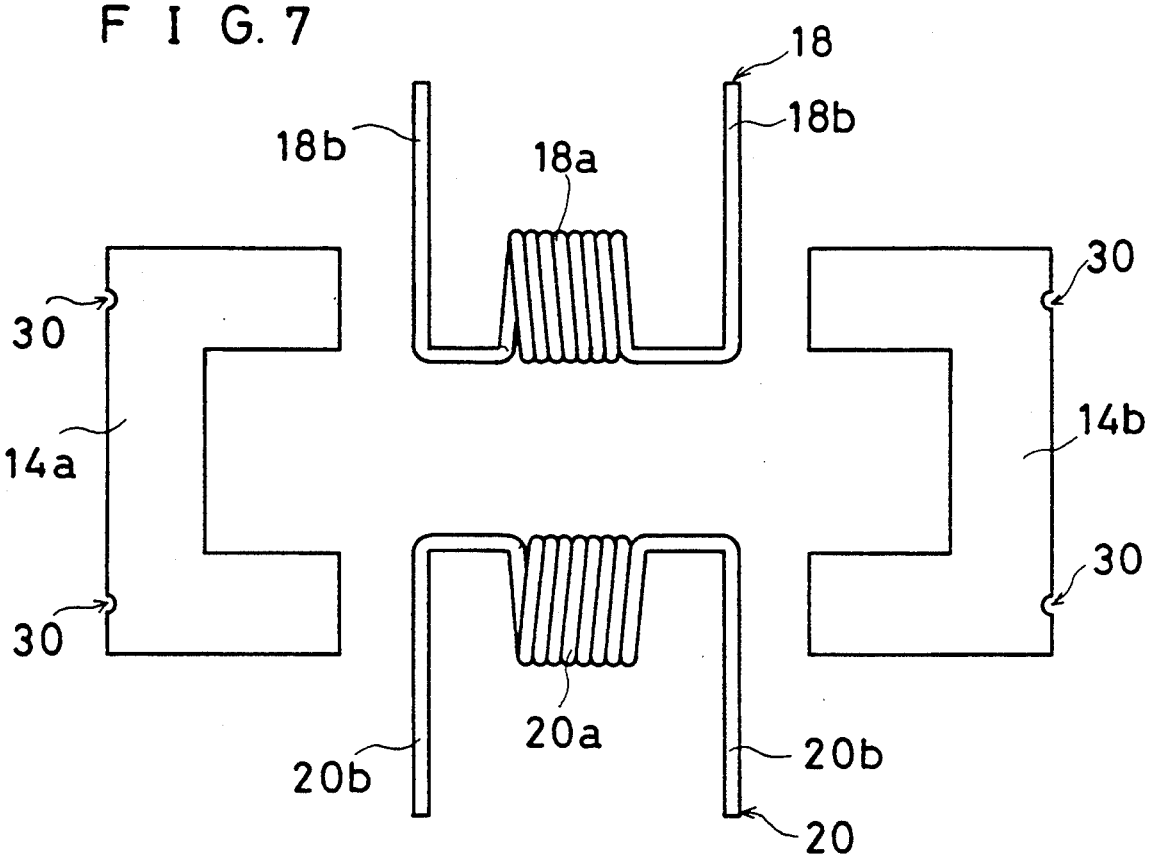
FIG. 7 is an exploded plan view and FIG. 8 are illustration views showing manufacturing a common-mode choking coil as shown in FIG. 5 and FIG. 6.

These coils 18 and 20, as shown in FIG. 7, are disposed so that the center lines of the wire-wound parts thereof 18*a* and 20*a* are parallel with each other, and on opposite sides thereof, the two U-shaped cores 14*a* and 14*b* are disposed. In this case, grooves 30 are formed on the side surfaces of the cores 14*a* and 14*b* corresponding to the lead parts 18*b* and 20*b*.

Figure 8:
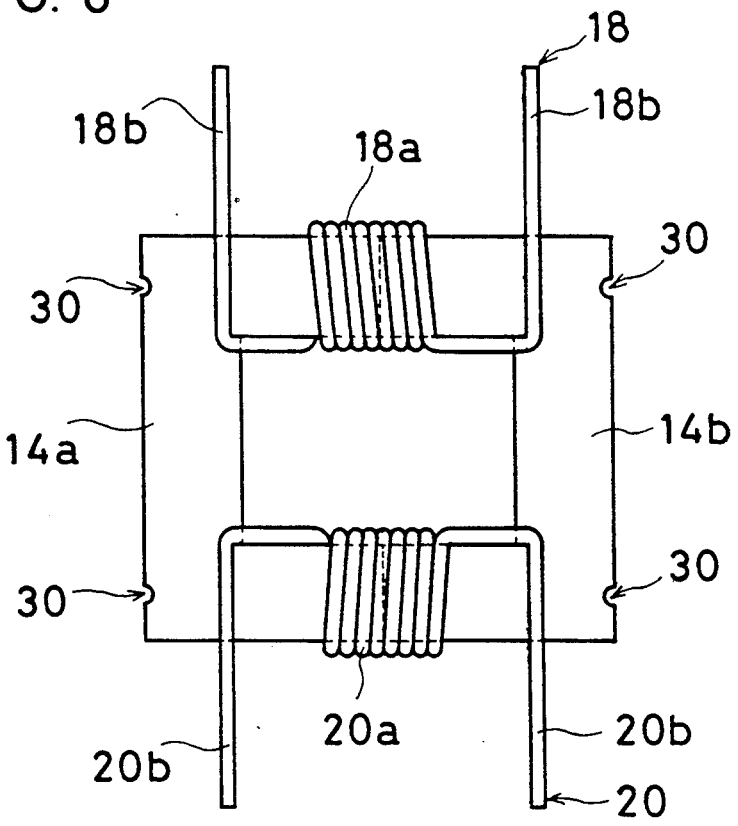

Next, as shown in FIG. 8, the two U-shaped cores 14*a* and 14*b* are made to butt against each other after being inserted through the wire-wound parts 18*a* and 20*a* of the coils 18 and 20. Then, both ends of the wire-wound parts 18*a* and 20*a* of the coils 18 and 20 are pulled toward the opposite sides of the cores 14*a* and 14*b*, and the lead parts 18*b* and 20*b* are fitted into the grooves 30. The spring property of the coils 18 and 20 tends to draw the ends of the coils together, and thereby the two U-shaped cores 14*a* and 14*b* are fixed butting against each other.

Figure 9:
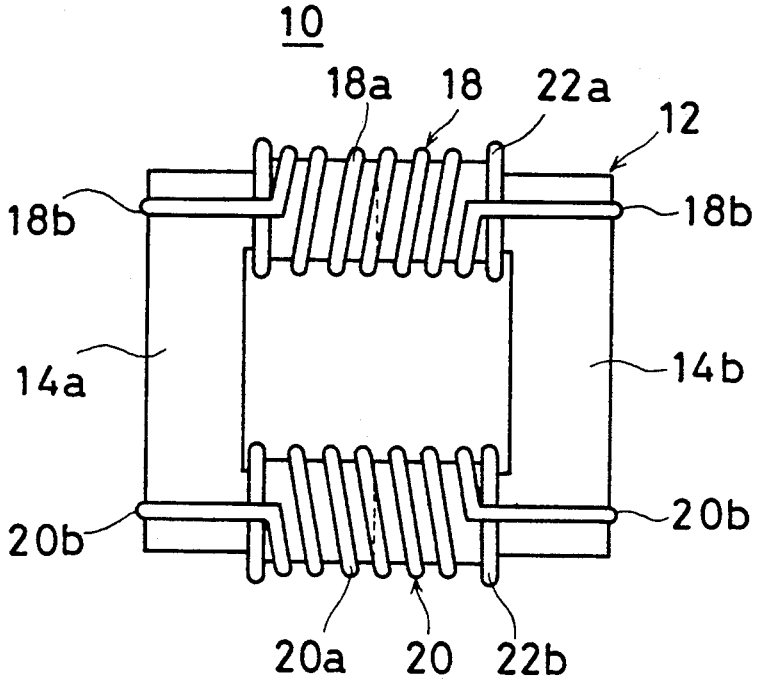
FIG. 9 is a plan view showing a modified example of the common-mode choking coil as shown in FIG. 5 and FIG. 6.

In this embodiment, the coils 18 and 20 are mounted directly on the legs of the closed magnetic path core 12, but as shown in FIG. 9, the coils 18 and 20 may be mounted on the legs of the closed magnetic path core 12 using bobbins 22*a* and 22*b*.

In the common-mode choking coil 10 having a structure as in FIGS. 5–9, the U-shaped cores 14*a* and 14*b* are fixed by the spring property of the coils 18 and 20, and therefore a separate part for fixing these coils can be dispensed with. Consequently, the cost of parts can be reduced in comparison with the type of coil using such a separate fixing part. Furthermore, since the lead parts 18*b* and 20*b* of the coils 18 and 20 can be used as terminals for connecting an external circuit, the ends of the coils do not have to be connected to separate terminals so the working cost can be reduced. As result, the common-mode choking coil 10 having such a structure can have a reduced manufacturing cost in comparison with the conventional one.

Furthermore, in the common-mode choking coil 10 having such a structure, since the wire-wound parts 18*a* and 20*a* of the coils 18 and 20 are pulled apart lengthwise after being mounted on the closed magnetic path core 12, the distance between the conductor windings becomes large. Consequently, the stray capacitance between the adjacent conductor wires is reduced, and the frequency region effective as a common-mode choking coil can be extended.

In addition, in each embodiment as described above, the colors of the coils 18 and 20 can indicate the winding direction thereof, permitting the coils to be color-identified. Thus, the two coils 18 and 20 are identified simply when the common-mode choking coil is assembled, so manufacturing errors can be prevented.

Figure 10:
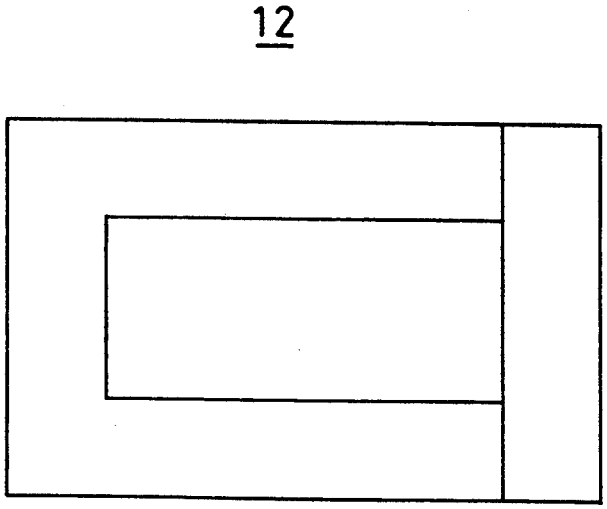
FIG. 10 is a plan view showing a modified example of the core used in each embodiment as described above.
Figure 11:
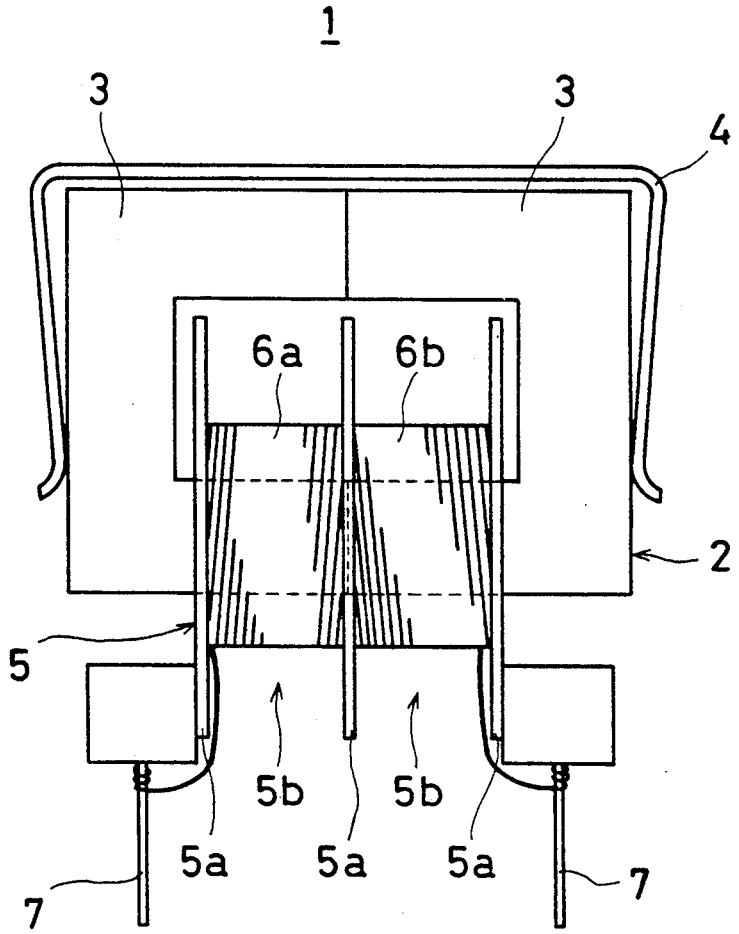
F I G. 11 PRIOR ART
FIG. 11 is a plan view showing one example of a conventional common-mode choking coil which is the background of the present invention.

In each embodiment as described above, two U-shaped cores are used to fabricate the closed magnetic path core 12. However as shown in FIG. 10, it may also be formed by combining a U-shaped core and an I-shaped core, and the shapes of these two cores can be changed arbitrarily.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A common-mode choking coil comprising:

a closed magnetic path core formed by combining two partial cores, and two single-layer-wound coils wound around two respective legs of said closed magnetic path core, wherein said two coils are formed by winding respective conductor wires in opposite directions with respect to said closed magnetic path core; and wherein said single-layer-wound coil is constituted by a wire-wound part formed by winding a conductor wire having a spring property, and lead parts extending from both ends of said wire-wound part, and said coil being mounted on the respective leg of said closed magnetic path core with said wire-wound part being pulled lengthwise and thereby stretched, and said coil being fixed to said closed magnetic path core by said lead parts which engage said two partial cores and draw them together by said spring property of said conductor wire; whereby said two partial cores are combined to form said closed magnetic path core.

2. A common-mode choking coil comprising:

a closed magnetic path core formed by combining two partial cores, and two bobbins mounted on two respective legs of said closed magnetic path core, and two single-layer-wound coils wound respectively around said two bobbins;

wherein said two coils are formed by winding respective conductor wires in opposite directions with respect to said closed magnetic path core; and wherein said single-layer-wound coil is constituted by a wire-wound part formed by winding a conductor wire having a spring property, and lead parts extending from both ends of said wire-wound part, and said coil being mounted on the respective leg of said closed magnetic path core with said wire-wound part being pulled lengthwise and thereby stretched, and said coil being fixed to said closed magnetic path core by said lead parts which engage said two partial cores and draw them together by said spring property of said conductor wire; whereby said two partial cores are combined to form said closed magnetic path core.

3. A common-mode choking coil in accordance with claim 1, wherein different respective colors are applied to said single-layer-wound coils as a function of the winding direction thereof.

4. A common-mode choking coil in accordance with claim 2, wherein different respective colors are applied to said single-layer-wound coils as a function of the winding direction thereof.

* * * * *